US011557190B2

(12) United States Patent
Schou et al.

(10) Patent No.: US 11,557,190 B2
(45) Date of Patent: Jan. 17, 2023

(54) ALARM MANAGEMENT MODULE FOR A WASTEWATER PUMPING STATION

(71) Applicant: GRUNDFOS HOLDING A/S, Bjerringbro (DK)

(72) Inventors: Christian Schou, Engesvang Engesvang (DK); Ole Hejn Pjengaard, Rander SØ (DK); Carsten Skovmose Kallesøe, Viborg (DK)

(73) Assignee: GRUNDFOS HOLDING A/S, Bjerringbro (DK)

( * ) Notice: Subject to any disclaimer, the term of this patent is extended or adjusted under 35 U.S.C. 154(b) by 12 days.

(21) Appl. No.: 17/054,438

(22) PCT Filed: May 2, 2019

(86) PCT No.: PCT/EP2019/061211
§ 371 (c)(1),
(2) Date: Nov. 10, 2020

(87) PCT Pub. No.: WO2019/215001
PCT Pub. Date: Nov. 14, 2019

(65) Prior Publication Data

US 2021/0233377 A1 Jul. 29, 2021

(30) Foreign Application Priority Data

May 11, 2018 (EP) ..... 18171930

(51) Int. Cl.
*G08B 21/00* (2006.01)
*G08B 21/18* (2006.01)
*E03F 5/22* (2006.01)

(52) U.S. Cl.
CPC ..... *G08B 21/182* (2013.01); *E03F 5/22* (2013.01)

(58) Field of Classification Search
CPC ..... G08B 21/182; E03F 5/22; F04D 15/0088
See application file for complete search history.

(56) References Cited

U.S. PATENT DOCUMENTS 4,369,438 A 1/1983 Wilhelmi
5,591,010 A * 1/1997 Van Zyl ..... G05D 9/12 417/12
5,935,449 A * 8/1999 Buehler ..... B01D 17/0208 210/744

(Continued)

FOREIGN PATENT DOCUMENTS

GB 2460301 A 12/2009

*Primary Examiner* — Ojiako K Nwugo
(74) *Attorney, Agent, or Firm* — McGlew and Tuttle, P.C.

(57) ABSTRACT

An alarm management module (13) is for a wastewater pumping station that includes at least one pump (9*a*, 9*b*) arranged for pumping wastewater out of a wastewater pit (1). The alarm management module (13) is configured to process at least one level variable (h) indicative of a filling level of the wastewater pit (1) and at least one capacity variable (p %, P %, C %) indicative of a pumping capacity of the wastewater pumping station. The alarm management module (13) is configured to trigger an intervention alarm only if all of the following conditions are met:

a) the at least one level variable (h) is at or above a predetermined alarm level threshold ($h_m$),
b) the at least one level variable (h) is increasing, and
c) the at least one capacity variable (p %, P %, C %) is below a capacity threshold.

22 Claims, 9 Drawing Sheets

(56) References Cited

U.S. PATENT DOCUMENTS

| | | | | |
|---|---|---|---|---|
| 6,309,539 | B1 * | 10/2001 | Mayer | C02F 3/288 210/138 |
| 7,221,282 | B1 * | 5/2007 | Ross | G08B 25/10 340/606 |
| 8,371,821 | B1 * | 2/2013 | Mehr | F04D 15/0218 417/40 |
| 8,594,851 | B1 | 11/2013 | Smaidris | |
| 9,709,431 | B1 | 7/2017 | Kinney et al. | |
| 9,885,360 | B2 * | 2/2018 | Boese | F04D 15/0066 |
| 10,634,133 | B2 * | 4/2020 | Johnson | F04B 49/025 |
| 2002/0005220 | A1 | 1/2002 | Struthers | |
| 2002/0166578 | A1 * | 11/2002 | Leblond | B01D 41/04 134/140 |
| 2004/0211228 | A1 * | 10/2004 | Nishio | D06F 39/081 68/23.5 |
| 2007/0286737 | A1 | 12/2007 | Johnson | |
| 2008/0031752 | A1 | 2/2008 | Littwin et al. | |
| 2008/0189055 | A1 * | 8/2008 | Nelson | G01G 17/06 702/45 |
| 2009/0314351 | A1 * | 12/2009 | McDonald | E03B 7/071 200/84 R |
| 2010/0064705 | A1 * | 3/2010 | Chauvin | F04B 49/10 700/282 |
| 2010/0122738 | A1 * | 5/2010 | Williamson | C02F 1/004 137/565.17 |
| 2014/0324406 | A1 * | 10/2014 | Nesbitt | E03F 3/00 703/9 |
| 2016/0163175 | A1 * | 6/2016 | Jenkins | G01G 19/414 177/1 |
| 2018/0013941 | A1 * | 1/2018 | Freeman | H04N 5/2254 |
| 2019/0194928 | A1 * | 6/2019 | Boren | E03F 1/007 |
| 2019/0275448 | A1 * | 9/2019 | Romers | B01D 24/4631 |

* cited by examiner

ALARM MANAGEMENT MODULE FOR A WASTEWATER PUMPING STATION

CROSS REFERENCE TO RELATED APPLICATIONS

This application is a United States National Phase Application of International Application PCT/EP2019/061211, filed May 2, 2019, and claims the benefit of priority under 35 U.S.C. § 119 of European Application 18171930.3, filed May 11, 2018, the entire contents of which are incorporated herein by reference.

TECHNICAL FIELD

The present disclosure relates in general to an alarm management module for a wastewater pumping station and to a method for operating a wastewater pumping station.

BACKGROUND

Sewage or wastewater collection systems for wastewater treatment plants typically comprise one or more wastewater pits, wells or sumps for temporarily collecting and buffering wastewater. Typically, wastewater flows into such pits passively under gravity flow and/or actively driven through a force main. One, two or more pumps are usually installed in or at each pit to pump wastewater out of the pit. If the inflow of wastewater is larger than the outflow for a certain period of time, the wastewater pit, well or sump will eventually overflow. Such overflows should be prevented as much as possible to avoid environmental impact. Therefore, it is known to trigger an overflow alarm when a certain filling level of the pit is reached. Operators and/or maintenance staff are requested to intervene and take action upon such an overflow alarm.

U.S. Pat. No. 8,594,851 B1 describes a wastewater treatment system and a method for reducing energy used in operation of a wastewater treatment facility.

It is a challenge for known alarm management systems to handle a large number of different simultaneous alarms among which operators and/or maintenance staff must decide which alarm to prioritise for intervening and taking action.

SUMMARY

In contrast to such known alarm management systems, embodiments of the present disclosure trigger fewer alarms in total, but wherein a higher fraction of alarms is actually useful for operators and/or maintenance staff to intervene and take action.

In accordance with a first aspect of the present disclosure, an alarm management module for a wastewater pumping station with at least one pump arranged for pumping wastewater out of a wastewater pit is provided, wherein the alarm management module is configured to process at least one level variable indicative of a filling level of the wastewater pit and at least one capacity variable indicative of a pumping capacity of the wastewater pumping station, and wherein the alarm management module is configured to trigger an intervention alarm only if all of the following conditions are met:

a) the at least one level variable is at or above a predetermined alarm level threshold,
b) the at least one level variable is increasing, and
c) the at least one capacity variable is below a capacity threshold.

The at least one level variable may, for instance, be a filling height h and/or a hydrostatic pressure $p_h$ being indicative of a filling level of the wastewater pit. The at least one capacity variable may, for instance, be C %=$q/q_{ref}$, i.e. a measured or estimated outflow q divided by a reference outflow $q_{ref}$. Even if the capacity variable is in fact to be understood as an efficiency, it should be noted that the term "capacity variable" is deliberately chosen to distinguish from the technical term "efficiency" of the pump(s). As an alternative to the above definition, the at least one capacity variable may, for instance, be defined as C %=$q-q_{ref}$, i.e. a measured or estimated outflow q subtracted by a reference outflow $q_{ref}$.

Alternatively or in addition, the at least one capacity variable may be $$p\% = \sqrt{\frac{\Delta p}{\Delta p_{ref}}} = \sqrt{\frac{p - p_0}{p_{ref} - p_0}} = \sqrt{\frac{rq^2}{r_0 q_{ref}^2}},$$

i.e. the square root of a measured pressure differential Δp at or downstream of the at least one pump divided by a reference pressure differential $\Delta p_{ref}$. A pipe characteristic may generally be approximated by a second order polynomial $p=rq^2+p_0$, wherein r is a pipe resistance parameter, q is an outflow and $p_0$ a zero-flow pressure. Therefore, the capacity variable p % may exceed 100% and even an upper capacity threshold, e. g. 105%, when a pipe downstream of the pump(s) is at least partially clogged, i.e. the pipe resistance r is larger than the pipe resistance $r_0$ of a clean pipe, but the pump(s) are working properly. However, in case of a clean pipe, the pipe resistance r equals the pipe resistance $r_0$, so a problem with the pump(s) is indicated when the capacity variable p % is below the capacity threshold. As an alternative to the above definition, the at least one capacity variable may, for instance, be defined as p %=$\Delta p-\Delta p_{ref}$, i.e. the difference between a measured pressure differential Δp at or downstream of the at least one pump and a reference pressure differential $\Delta p_{ref}$.

Alternatively or in addition, the at least one capacity variable may be $$P\% = \frac{P - P_0}{P_{ref} - P_0},$$

wherein P is a power consumed by the at least one pump, $P_0$ is a zero-flow power consumption of the at least one pump and $P_{ref}$ is a reference power consumption of the at least one pump. The pump(s) may be fixed-speed pump(s) or speed-controlled pump(s). In case of speed-controlled pump(s), the pumps(s) should be running at maximum speed when the at least one level variable is at or above the predetermined alarm level threshold. When $P_0$ is not known, it may be approximated by $0.5 \cdot P_{ref}$ when the maximum power consumption is used as the reference power consumption. As an alternative to the above definition, the at least one capacity variable may, for instance, be defined as P %=$P-P_{ref}$, i.e. the difference between a power consumed by the at least one pump and a reference power consumption $P_{ref}$.

The capacity threshold may be a pre-defined percentage, e. g. 95%, or an absolute value. The capacity threshold may be adjusted and set by an operator and/or maintenance staff. The above-mentioned third condition c), i.e. whether the at least one capacity variable is below the capacity threshold or not, minimises the number of moot alarms without suppressing useful intervention alarms. An alarm in terms of operator intervention would be moot, for instance, if the first two abovementioned conditions a) and b) were met, i.e. the at least one level variable is at or above a predetermined alarm level threshold and the at least one level variable is increasing, but the third above-mentioned condition c) were not met, i.e. the at least one capacity variable is at or above the capacity threshold. In this situation, for example at times of heavy rainfall, the inflow of wastewater into the wastewater pit is higher than the wastewater pumping station is able to pump out at maximum capacity. An overflow is thus inevitable and there is nothing an operator can do about it. Therefore, no intervention alarm is triggered in this case. The operator and/or maintenance staff, who often operate a multitude of wastewater pits, can thus concentrate their efforts on those pits where an intervention alarm is actually triggered indicating that the operator can improve the situation by taking action, such as switching, repairing, exchanging, cleaning a pump or a non-return valve and/or cleaning an outflow pipe.

Optionally, the alarm management module may be further configured to trigger an information warning if all of the following conditions are met:

a) the at least one level variable is at or above the predetermined alarm level threshold,
b) the at least one level variable is increasing, and
c) the at least one capacity variable is at or above the capacity threshold.

Thereby, the operator merely receives, in such a futile situation, an information warning instead of a moot alarm when an inevitable overflow is expected to happen.

Optionally, the capacity variable may be determined relative to a predetermined reference capacity or relative to a statistically determined reference capacity. The reference capacity may, for instance, be a reference outflow $q_{ref}$, a reference pressure $\Delta p_{ref}$, and/or a reference power consumption $P_{ref}$, which may, for instance, be determined statistically by recording the highest value or an averaged or typical value over a defined past time period of normal faultless operation. Alternatively or in addition, the reference outflow $q_{ref}$, the reference pressure $\Delta p_{ref}$, and/or the reference power consumption $P_{ref}$ may be a fixed nominal value based on the layout of the wastewater pumping station and/or its pump(s).

Optionally, the alarm management module may be further configured to statistically determine, as a reference for the capacity variable, a reference capacity during a time period when all of the following conditions are met:

a) the at least one level variable is below the predetermined alarm level threshold,
b) the at least one level variable is not increasing, and
c) the at least one capacity variable is at or above the capacity threshold.

These conditions indicate a time period of normal faultless operation during which the reference capacity may be determined.

Optionally, the at least one capacity variable may be based on

- a flow variable q indicative of a flow at or downstream of an outlet of the at least one pump when pumping wastewater out of the wastewater pit,
- a pressure variable Δp indicative of a pressure at or downstream of an outlet of the at least one pump when pumping wastewater out of the wastewater pit, and/or
- a power variable P indicative of a hydraulic power provided by the at least one pump when pumping wastewater out of the wastewater pit.

The flow variable q may be measured by a flow meter at or downstream of an outlet of the pump(s) or estimated based on a pressure or power value. The capacity variable may then, for instance, be $C\% = q/q_{ref}$, i.e. the measured or estimated flow variable q divided by the reference outflow $q_{ref}$. The pressure variable Δp may be a pressure differential measured by a pressure sensor at or downstream of an outlet of the pump(s), so that the capacity variable may then be $$p\% = \sqrt{\frac{\Delta p}{\Delta p_{ref}}} = \sqrt{\frac{p - p_0}{p_{ref} - p_0}} = \sqrt{\frac{rq^2}{r_0 q_{ref}^2}},$$

i.e. the square root of a measured pressure differential Δp at or downstream of the at least one pump divided by the reference pressure differential $\Delta p_{ref}$. The power variable P may be measured by a sensor and/or based on an electrical power, voltage and/or current consumed by the pump(s). The capacity variable may then be defined as $$P\% = \frac{P - P_0}{P_{ref} - P_0}.$$

The electrical power consumption of the pump(s) may be used the power variable P indicative of a hydraulic power provided by the pump(s) when pumping wastewater out of the wastewater pit.

Optionally, the alarm management module may further be configured to process a plurality of pump specific capacity variables each of which is indicative of a pumping capacity of one of a plurality of pumps arranged for pumping wastewater out of the wastewater pit. Such pump specific capacity variables for each of a plurality of pumps allow monitoring the capacity of each pump constantly, regularly or sporadically during "normal" operation when the at least one level variable is below the predetermined alarm level threshold, i.e. the first condition a) for an intervention alarm is not fulfilled, and/or when the at least one level variable is not increasing, i.e. the second condition b) for an intervention alarm is not fulfilled. An operator may then be warned if the at least one capacity variable is below a capacity threshold, i.e. the third condition c) for an intervention alarm is fulfilled. An operator may decide to intervene and take action for restoring the capacity of the wastewater pumping station upon such a capacity warning.

As the number of potential causes for a degradation of the capacity of the wastewater pumping station scales with the number of pumps, it is useful to provide an operator with a problem localisation information to facilitate and accelerate the process of restoring the capacity of the wastewater pumping station. During "normal" operation, the pumps are preferably not operating simultaneously but in turns only one at a time. The total of operating hours of all pumps and associated wear are preferably evenly distributed among the pumps. A second, third or more pumps are preferably only switched on in addition to already running pump(s) if the wastewater level in the pit exceeds an according switch level (below the alarm level threshold). Analogously, the second, third or more pumps that are running in addition to already running pump(s) are switched off again if the wastewater level in the pit falls below the according switch level.

Optionally, wherein the alarm management module may be further configured to trigger a capacity warning including a problem localisation information, wherein the problem localisation information is based on whether:

a) only one of the pump specific capacity variables is below the capacity threshold indicating a problem with the associated pump, b) only one of the pump specific capacity variables is not below the capacity threshold indicating a backflow through the associated pump when it is turned off, or c) all of the pump specific capacity variables are below the capacity threshold or above an upper capacity threshold indicating a pipe clogging downstream of all the pumps.

Once a pump specific capacity variable $C_i$%, $p_i$% and/or $P_i$% is processed for each pump i, the pump specific capacity variables can be compared to add a problem localisation information to a capacity warning. For instance, if only one of the pump specific capacity variables is below the capacity threshold, a problem with the associated pump is indicated. On the other hand, if only one of the pump specific capacity variables is not below the capacity threshold, a backflow through the said pump is indicated, i.e. a non-return valve at the associated pump may be leaking. This means, that the other pump(s) are pumping wastewater back into the pit through said pump, which results in a degraded pump specific capacity variable for all other pumps. If all of the pump specific capacity variables $C_i$%, $p_i$% and/or $P_i$% are below the capacity threshold or, in case of $p_i$%, above an upper capacity threshold, a pipe clogging downstream of all the pumps is indicated. The operator is thus able to switch, repair and/or exchange the specified problematic pump or non-return valve, or to clean the pipe based on the problem localisation information in the capacity warning.

Optionally, the alarm management module may be further configured to process a plurality of pairs of a first pump specific capacity variable and a second pump specific capacity variable, each pair being indicative of a pumping capacity of one of a plurality of pumps arranged for pumping wastewater out of the wastewater pit, and wherein the alarm management module is configured to trigger a capacity warning including a problem localisation information, wherein the problem localisation information is based on whether:

a) both the first pump specific capacity variable and second pump specific capacity variable of only one of the pumps are below the capacity threshold indicating a problem with the associated pump, b) the first pump specific capacity variable of only one of the pumps is not below the capacity threshold indicating backflow through the associated pump when it is turned off, c) the first pump specific capacity variables of all of the pumps are above an upper capacity threshold and the second pump specific capacity variables of all of the pumps are not below the capacity threshold indicating a pipe clogging downstream of all the pumps, or d) the first pump specific capacity variable of all of the pumps except for one pump are above an upper capacity threshold and the second pump specific capacity variable of all of the pumps except for said one pump are not below the capacity threshold indicating a pipe clogging downstream of all the pumps and a problem with said one pump.

For example, the first pump specific capacity variable may be $p_i$% and the second pump specific capacity variable may be $C_i$% or $P_i$%. It is advantageous to process a plurality of pairs of the first pump specific capacity variable and the second pump specific capacity variable in order to improve the reliability and elaborateness of the problem localisation information. For instance, when both the first pump specific capacity variable and a second pump specific capacity for each pump are processed, the redundant capacity information for each pump is more reliable, because a false capacity warning is less likely, for instance, when both the first pump specific capacity variable and the second pump specific capacity variable are below the capacity threshold. However, when the first pump specific capacity variable and the second pump specific capacity variable indicate differently, one of them may be given a higher weight for indicating a problem. For instance, when the first pump specific capacity variables $p_i$% of all of the pumps are above an upper capacity threshold, e.g. 105%, but the second pump specific capacity variables $C_i$% or $P_i$% of all of the pumps are above the capacity threshold, a pipe clogging downstream of all the pumps is nevertheless indicated based on $p_i$% weighted higher than $C_i$% or $P_i$% in this case. Furthermore, a simultaneous pipe clogging and problem with one pump may be indicated in the problem localisation information, when the first pump specific capacity variable $p_i$% of all of the pumps except for said one pump are above an upper capacity threshold, e.g. 105%, and the second pump specific capacity variable $C_i$% or $P_i$% of all of the pumps except for said one pump are not below the capacity threshold.

Analogous to the alarm management module described above and in accordance with a second aspect of the present disclosure, a method for operating a wastewater pumping station with at least one pump arranged for pumping wastewater out of a wastewater pit is provided, the method comprising:

processing at least one level variable indicative of a filling level of the wastewater pit and a least one capacity variable indicative of a pumping capacity of the wastewater pumping station, and triggering an intervention alarm only if all of the following conditions are met:

a) the at least one level variable is at or above a predetermined alarm level threshold, b) the at least one level variable is increasing, and c) the at least one capacity variable is below a capacity threshold.

Optionally, the method may further comprise:

triggering an information warning if all of the following conditions are met:

a) the at least one level variable is at or above the predetermined alarm level threshold, b) the at least one level variable is increasing, and c) the at least one capacity variable is at or above the capacity threshold.

Optionally, the capacity variable may be determined relative to a predetermined reference capacity and/or relative to a statistically determined reference capacity.

Optionally, the method may further comprise:

statistically determining, as a basis for the capacity variable, a reference capacity during a time period when all of the following conditions are met:

a) the at least one level variable is below the predetermined alarm level threshold, b) the at least one level variable is not increasing, and c) the at least one capacity variable is at or above the capacity threshold.

Optionally, the at least one capacity variable may be based on a flow variable indicative of a flow at or downstream of an outlet of the at least one pump when pumping wastewater out of the wastewater pit, a pressure variable indicative of a pressure at or downstream of an outlet of the at least one pump when pumping wastewater out of the wastewater pit, and/or a power variable indicative of a hydraulic power provided by the at least one pump when pumping wastewater out of the wastewater pit.

Optionally, the at least one capacity variable may be based on at least one pressure signal or flow signal provided by at least one pressure sensor or flow sensor, respectively, at or downstream of an outlet of the at least one pump.

Optionally, the at least one capacity variable may be based on an electrical variable, such as power, voltage and/or current, consumed by the at least one pump.

Optionally, the at least one capacity variable may be based on a ratio between an actual pressure at or downstream of an outlet of the at least one pump when pumping wastewater out of the wastewater pit and a reference pressure determined during a time period when all of the following conditions are met:

a) the at least one level variable is below the predetermined alarm level threshold, b) the at least one level variable is not increasing, and c) the at least one capacity variable is at or above the capacity threshold.

Optionally, the method may further comprise:

processing a plurality of pump specific capacity variables each of which is indicative of a pumping capacity of one of a plurality of pumps arranged for pumping wastewater out of the wastewater pit.

Optionally, the method may further comprise:

triggering a capacity warning including a problem localisation information, wherein the problem localisation information is based on whether:

a) only one of the pump specific capacity variables is below the capacity threshold indicating a problem with the associated pump, b) only one of the pump specific capacity variables is not below the capacity threshold indicating a backflow through the associated pump when it is turned off, or c) all of the pump specific capacity variables are above an upper capacity threshold indicating a pipe clogging downstream of all the pumps.

Optionally, the method may further comprise:

processing a plurality of pairs of a first pump specific capacity variable and a second pump specific capacity variable, each pair being indicative of a pumping capacity of one of a plurality of pumps arranged for pumping wastewater out of the wastewater pit, and triggering a capacity warning including a problem localisation information, wherein the problem localisation information is based on whether:

a) both the first pump specific capacity variable and second pump specific capacity variable of only one of the pumps are below the capacity threshold indicating a problem with the associated pump, b) the first pump specific capacity variable of only one of the pumps is not below the capacity threshold indicating a problem downstream of the associated pump, c) the first pump specific capacity variables of all of the pumps are above an upper capacity threshold and the second pump specific capacity variables of all of the pumps are not below the capacity threshold indicating a pipe clogging downstream of all the pumps, or d) the first pump specific capacity variable of all of the pumps except for one pump are above an upper capacity threshold and the second pump specific capacity variable of all of the pumps except for said one pump are not below the capacity threshold indicating a pipe clogging downstream of all the pumps and a problem with said one pump.

The alarm management module described above and/or some or all of the steps of the method described above may be implemented in form of compiled or uncompiled software code that is stored on a computer readable medium with instructions for executing the method. Alternatively or in addition, some or all method steps may be executed by software in a cloud-based system, in particular the alarm management module may be partly or in full implemented on a computer and/or in a cloud-based system.

Embodiments of the present disclosure will now be described by way of example with reference to the following figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION

Figure 1:
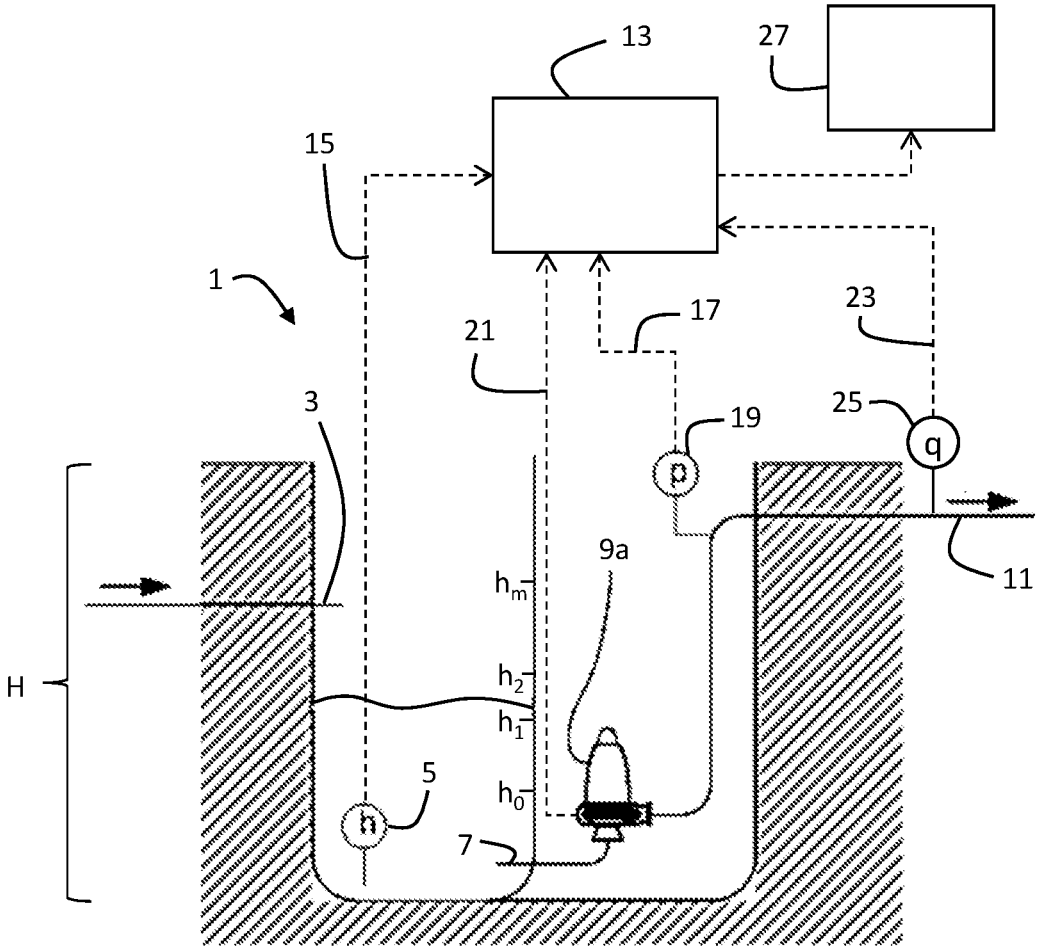
FIG. 1 is a schematic cross-sectional view on a wastewater pit of a wastewater pumping station with one pump, wherein the wastewater pumping station is connected with an example of the alarm management module according to the present disclosure.

FIG. 1 shows a wastewater pit 1 of a wastewater pumping station. The wastewater pit 1 has a certain height H and can be filled through an inflow port 3. The current level of wastewater is denoted as h and may be continuously or regularly monitored by means of a level sensor 5, e.g. a hydrostatic pressure sensor at the bottom of the wastewater pit 1 and/or an ultrasonic distance meter for determining the surface position of the wastewater in the pit 1 by detecting ultrasonic waves being reflected by the wastewater surface. Alternatively or in addition, the wastewater pit 1 may be equipped with one or more photoelectric sensors or other kind of sensors at one or more pre-defined levels for simply indicating whether the wastewater has reached the respective pre-defined level or not.

The wastewater pumping station further comprises an outflow port 7 near the bottom of the wastewater pit 1, wherein the outflow port 7 is in fluid connection with a pump 9*a* for pumping wastewater out of the wastewater pit into a force main 11. In case pump 9*a* is submersed in the wastewater pit 1, an inlet of the pump 9*a* may be the outflow port 7. The pump 9*a* may be arranged, as shown in FIGS. 1 and 2, outside of the wastewater pit 1 or submerged at the bottom of the wastewater pit 1 in form of a submersible pump.

An alarm management module 13 is signal connected with the level sensor 5 to receive a level signal indicative of a filling level of the wastewater pit 1 via wired or wireless signal connection 15. The alarm management module 13 is configured to process the level signal as a level variable h in order to monitor whether the level variable h is at or above a predetermined alarm level threshold $h_m$.

Figure 2:
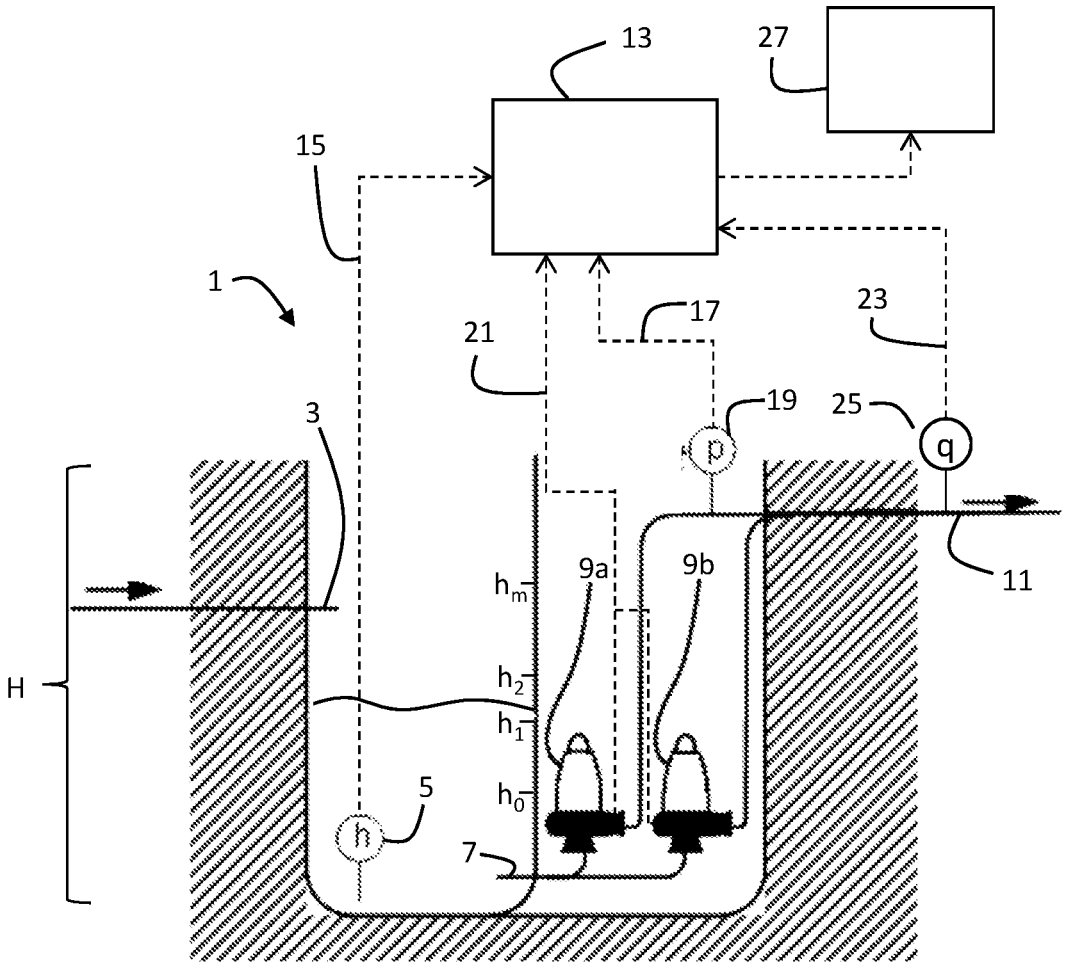
FIG. 2 is a schematic cross-sectional view on a wastewater pit of a wastewater pumping station with two pumps, wherein the wastewater pumping station is connected with an example of the alarm management module according to the present disclosure.

FIGS. 1 and 2 show three options for a further signal connections of the alarm management module 13, any of which may be implemented alone or in combination with one or two of the other options. The first option is a wired or wireless signal connection 17 with a pressure sensor 19 at or downstream of the pump 9*a*. The second option is a wired or wireless signal connection 21 with power electronics of the pump 9*a* or a power sensor in the pump 9*a*. The third option is a wired or wireless signal connection 23 with a flow meter 25 at or downstream of the pump 9*a*. The signal connections 15, 17, 21, 23 may be separate communication channels or combined in a common communication channel or bus. The alarm management module 13 is configured to receive a respective pressure, power and/or flow signal via the signal connections 17, 21, 23 and to process a respective capacity variable, which is indicative of a pumping capacity of the wastewater pumping station.

The first option of using a pressure signal from a pressure sensor 19 at or downstream of the pump 9*a* gives the alarm management module 13 the opportunity to process a capacity variable defined as $$p\% = \sqrt{\frac{\Delta p}{\Delta p_{ref}}} = \sqrt{\frac{rq^2}{r_0 q_{ref}^2}},$$

i.e. the square root of a measured pressure differential Δp at or downstream of the at least one pump divided by a reference pressure differential $\Delta p_{ref}$. The pressure differential Δp may be $\Delta p = p - p_0$, i.e. a measured pressure value p minus a measured zero-flow pressure value $p_0$.

The second option of using a power signal from pump power electronics or a power sensor at the pump 9*a* gives the alarm management module 13 the opportunity to process a capacity variable defined as $$P\% = \frac{P - P_0}{P_{ref} - P_0},$$

wherein P is a power consumed by the at least one pump, $P_0$ is a zero-flow power consumption of the at least one pump and $P_{ref}$ is a reference power consumption of the at least one pump. The pump(s) may be fixed-speed pump(s) or speed-controlled pump(s). In case of speed-controlled pump(s), the pumps(s) should be running at maximum speed when the at least one level variable is at or above the predetermined alarm level threshold. When $P_0$ is not known, it may be approximated by $0.5 \cdot P_{ref}$ when the maximum power consumption is used as the reference power consumption.

The third option of receiving a flow signal from a flow meter 25 may be used to process a capacity variable being defined as $C\% = q/q_{ref}$, i.e. the measured outflow q divided by a reference outflow $q_{ref}$. However, as the flow meter 25 may be quite expensive and may require regular maintenance, it may be preferred to estimate the outflow q. For instance, the flow q may be estimated by $$q \approx s\frac{\lambda_0}{\omega} + s\frac{\lambda_1}{\omega}\Delta p + s\frac{\lambda_2}{\omega^2}P + s\lambda_3\omega,$$

wherein s is the number of running pumps, ω is the pump speed, Δp is the measured pressure differential, P is the power consumption of the running pump(s), and $\lambda_0$, $\lambda_1$, $\lambda_2$ and $\lambda_3$ are pump parameters that may be known from the pump manufacturer or determined by calibration.

In any of the above three options for the capacity variable, the capacity variable may be determined relative to a predetermined or statistically determined reference capacity. The reference capacity may, for instance, be a reference outflow $q_{ref}$, a reference pressure $\Delta p_{ref}$, and/or a reference power consumption $P_{ref}$, respectively, which may, for instance, be determined statistically by recording the highest value or an averaged or typical value over a defined past time period of normal faultless operation. Alternatively or in addition, the reference outflow $q_{ref}$, the reference pressure $\Delta p_{ref}$, and/or the reference power consumption $P_{ref}$ may be a fixed nominal value based on the layout of the wastewater pumping station and/or its pump(s).

The alarm management module 13 is configured to trigger an intervention alarm based on both the level variable and the at least one the capacity variable for outputting the intervention alarm on an output device 27. The output device 27 may be a display and/or a loudspeaker on a mobile or stationary device for an operator to take notice of a visual and/or acoustic signal as the intervention alarm. An intervention alarm is only triggered by the alarm management module 13 if all of the following conditions are met:

a) the at least one level variable h is at or above a predetermined alarm level threshold D,
b) the at least one level variable h is increasing, and
c) the at least one capacity variable p %, P % and/or C % is below a capacity threshold, e.g. 95%.

Thus, an intervention alarm is not triggered if only the first two conditions a) and b) are fulfilled, but not the third condition c). In such a case of an inevitable overflow due to a too large wastewater inflow that the wastewater pumping station cannot cope with, an information warning may be triggered. The operator may be informed about this situation, but not asked to intervene, because the capacity variable is high and indicates that an operator cannot significantly improve the situation by intervening anyway.

Figure 3:
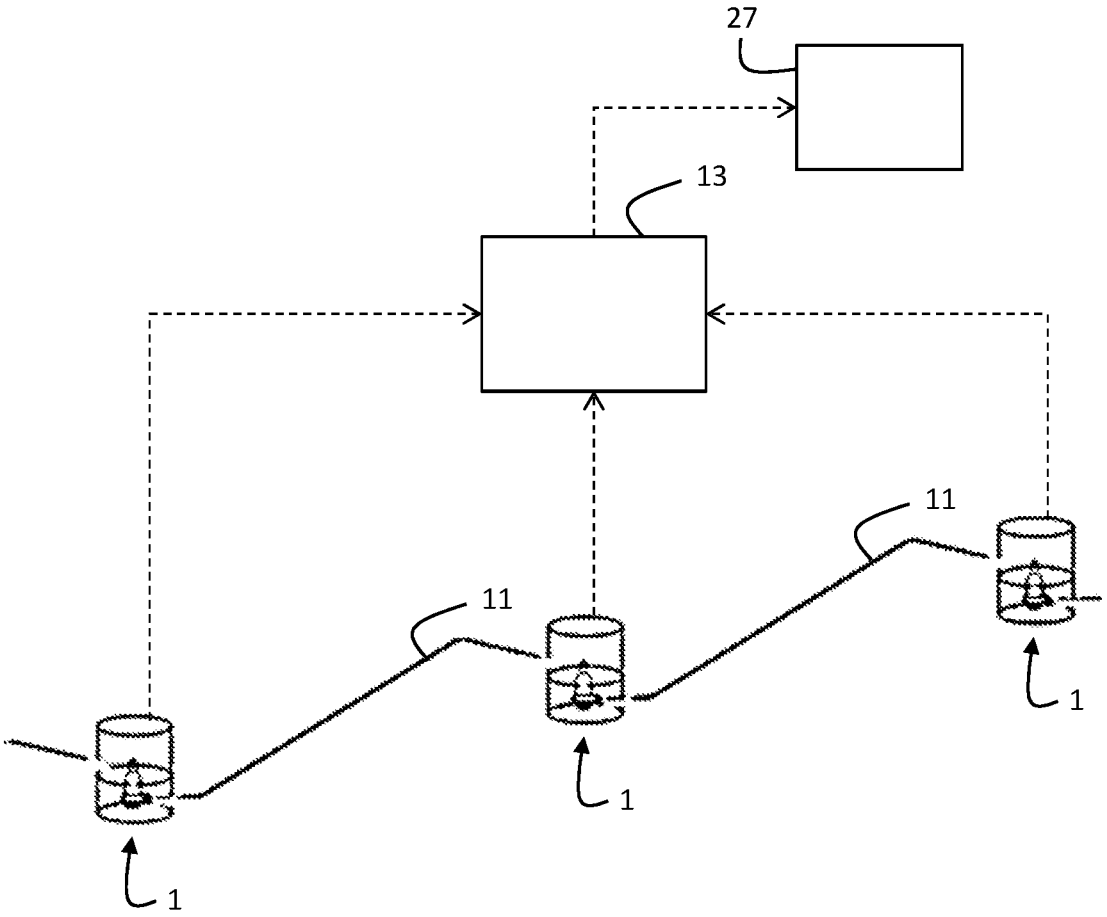
FIG. 3 is a schematic view on a chain of wastewater pumping stations, wherein each wastewater pumping station is connected with an example of the alarm management module according to the present disclosure.

FIG. 3 shows a chain of wastewater pumping stations being connected by respective force mains 11 through which a lower level wastewater pumping station is able to pump wastewater to the next higher level wastewater pumping station against gravity. As each of the wastewater pumping stations is monitored by the alarm management module 13, it is most likely, e. g. at times of heavy rainfall, that all wastewater pumping stations would be simultaneously showing an alarm situation if the alarm management module 13 were not monitoring the at least one capacity variable p %, P % and/or C % for distinguishing between an intervention alarm and an information warning. The alarm management module 13 only triggers an intervention alarm for those wastewater pumping stations for which a low capacity variable p %, P % and/or C % indicates that the operator can improve the situation by intervening.

Figure 4:
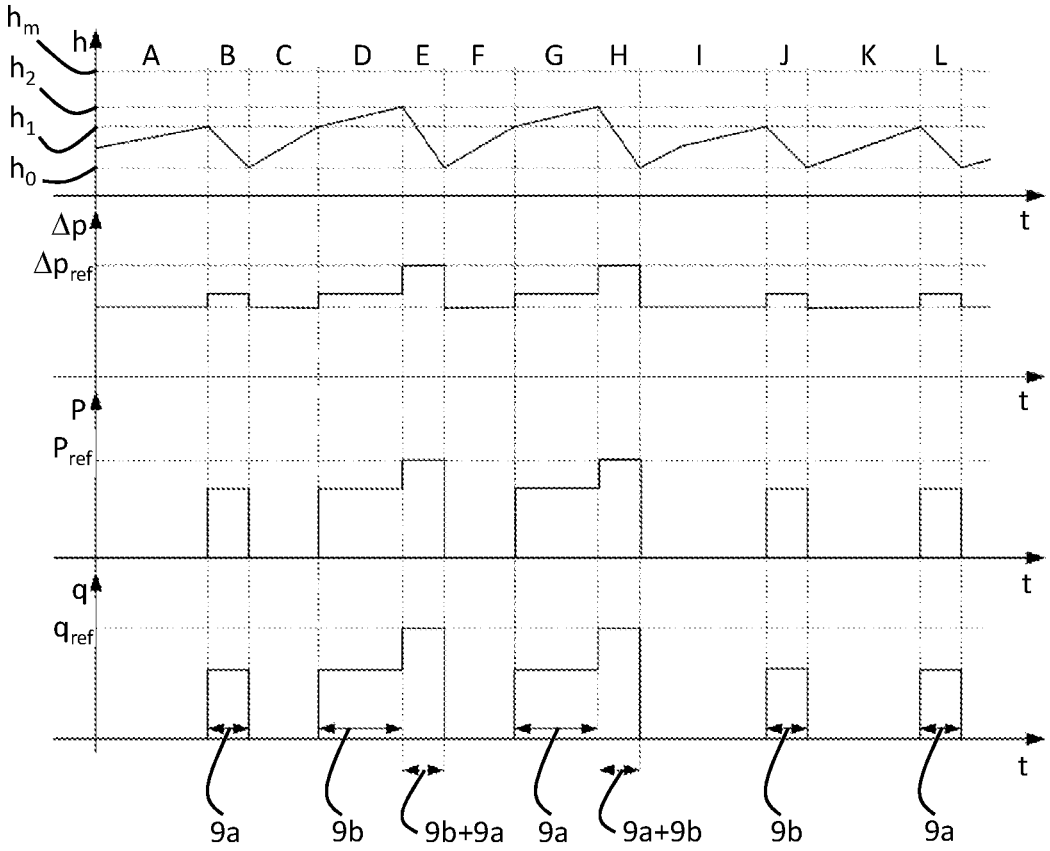
FIG. 4 is a schematic diagram of a level variable and different capacity variables over time during normal operation of a wastewater pumping station with two pumps, wherein the wastewater pumping station is connected with an example of the alarm management module of the present disclosure and/or operated according to an example of the method of the present disclosure.

FIG. 4 shows four diagrams of the level variable h and, according to the three options for the capacity variable, the pressure p, the power consumption P and/or the measured or estimated outflow q over time t during time periods A, B, C, D, . . . , K and L of normal faultless pump cycles of the two-pump system as shown in FIG. 2. FIG. 4 indicates four thresholds for the level variable h by horizontal dotted lines, i.e. a stop level threshold $h_0$, a first start level threshold $h_1$, a second start level threshold $h_2$ and an alarm level threshold $h_m$.

During the first time period A shown in FIG. 4, the wastewater level is increasing between the stop level threshold $h_0$ and the first start level threshold $h_1$. No pump is running at this point. So, there is no outflow p and no power consumption P. The pressure p equals a zero-flow pressure $p_0$, i.e. the pressure differential $\Delta p = p - p_0$ is zero.

Once the wastewater level reaches the first start level threshold $h_1$, the first one 9*a* of the two pumps 9*a*, 9*b* is started in the second time period B to drive an outflow q at a power consumption P generating a pressure p. The outflow q is higher than the inflow into the wastewater pit 1 and the level variable h drops. It should be noted that operating only one of two pumps of the wastewater pumping station means that the wastewater pumping station is running at half or less capacity. The capacity variables $$p\% = \sqrt{\frac{\Delta p}{\Delta p_{ref}}} = \sqrt{\frac{rq^2}{r_0 q_{ref}^2}},\ P\% = \frac{P - P_0}{P_{ref} - P_0}$$

and/or C %=q/$q_{ref}$ are thus far below 100%. Obviously, running at this low capacity is intended to save energy, because a higher capacity is not needed. In case of speed-controlled pumps as an alternative, both pumps may be running at half speed, for instance. There is no alarm situation as the level variable is neither beyond the alarm level threshold $h_m$ (condition a)) nor is it increasing (condition b)). The first pump 9*a* stops when the level variable drops below the stop level threshold $h_0$ in order to prevent the pump 9*a* from running dry.

During the third time period C, the inflow is higher than during the first time period A. Once the wastewater level reaches the first start level threshold $h_1$ again, the second one 9*b* of the two pumps 9*a*, 9*b* is started in the fourth time period D to drive an outflow q at a power consumption P generating a pressure p. The pumps may be operated in alternating order to evenly distribute operating hours and corresponding wear among the pumps. This time, however, the outflow q is still lower than the inflow into the wastewater pit 1 so that the level variable h still rises during the fourth time period D.

Once the wastewater level reaches the second start level threshold $h_2$, the first pump 9*a* is started in the fifth time period E in addition to the already running second pump 9*b*. The wastewater pumping station is now running at maximum capacity with all available pumps. The capacity variables $$p\% = \sqrt{\frac{\Delta p}{\Delta p_{ref}}} = \sqrt{\frac{rq^2}{r_0 q_{ref}^2}},\ P\% = \frac{P - P_0}{P_{ref} - P_0}$$

and/or C %=q/$q_{ref}$ are thus close to 100%. The outflow close to $q_{ref}$, which is preferably a maximum outflow, generated together by both pumps 9*a*, 9*b* at the reference power consumption $P_{ref}$, is higher than the inflow resulting in a dropping wastewater level h during the fifth time period E. Both pumps 9*a*, 9*b* stop when the level variable drops below the stop level threshold $h_0$ in order to prevent the pumps 9*a*, 9*b* from running dry.

During the following time periods F, G and H, the situation is the same as during the time periods C, D and E with the same inflow and the only difference that the first pump 9*a* starts in time period G and the second pump 9*b* joins in during time period H.

During the time period I, the inflow drops to the level as it was during the first time period A. Therefore, during time periods J, K and L, only one of the pumps 9*a*, 9*b* suffices to bring the wastewater level h down to the stop level threshold $h_0$.

The time periods E and H, when the wastewater pumping station is running faultlessly at maximum capacity may be used to determine statistically the reference outflow $q_{ref}$, the reference pressure $\Delta p_{ref}$, and/or the reference power consumption $P_{ref}$. For instance, the highest values among several faultless pump cycles at maximum capacity may be recorded as the respective reference values. The following conditions are met during the time periods E and H:

a) the level variable h is below the predetermined alarm level threshold $h_m$, b) the level variable h is not increasing, and c) the capacity variables $$p\% = \sqrt{\frac{\Delta p}{\Delta p_{ref}}} = \sqrt{\frac{rq^2}{r_0 q_{ref}^2}},\ P\% = \frac{P - P_0}{P_{ref} - P_0}$$

and/or C %=q/$q_{ref}$ are at or above the capacity threshold, e.g. 95%.

Figure 5:
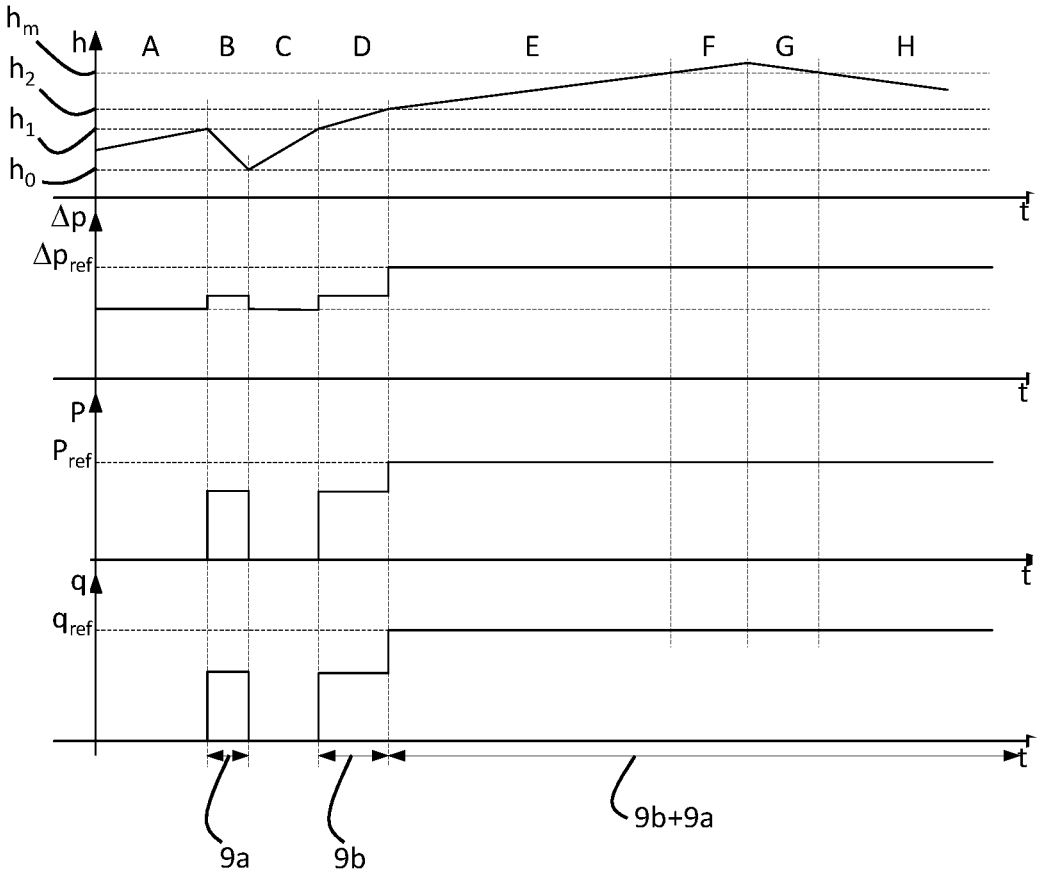
FIG. 5 is a schematic diagram of a level variable and different capacity variables over time during a futile situation of a wastewater pumping station with two pumps, wherein the wastewater pumping station is connected with an example of the alarm management module of the present disclosure and/or operated according to an example of the method of the present disclosure.

FIG. 5 shows a situation in which the level variable h is above the alarm level threshold $h_m$ during time periods F and G. Since time period E, the level variable h is above the level threshold $h_2$, so that both pumps 9*a*, 9*b* are running at maximum capacity during time periods E, F, G and H trying to reduce the wastewater level h. However, the inflow is so high that the maximum capacity of the wastewater pumping station does not suffice to prevent the level variable h from rising above the alarm level threshold $h_m$. In time periods G and H, the inflow has reduced so that the pumps 9*a*, 9*b* can bring the wastewater level h below the alarm level threshold $h_m$ again. It is important to note that no intervention alarm is triggered by the alarm management module 13 during time periods F and G. The capacity variables $$p\% = \sqrt{\frac{\Delta p}{\Delta p_{ref}}} = \sqrt{\frac{rq^2}{r_0 q_{ref}^2}},\ P\% = \frac{P - P_0}{P_{ref} - P_0}$$

and/or C %=q/$q_{ref}$ are at or above the capacity threshold, e.g. 95% during time periods E, F, G and H. The wastewater pumping station operates as pit as it gets and an operator would not be able to improve the situation by intervening.

Figure 6:
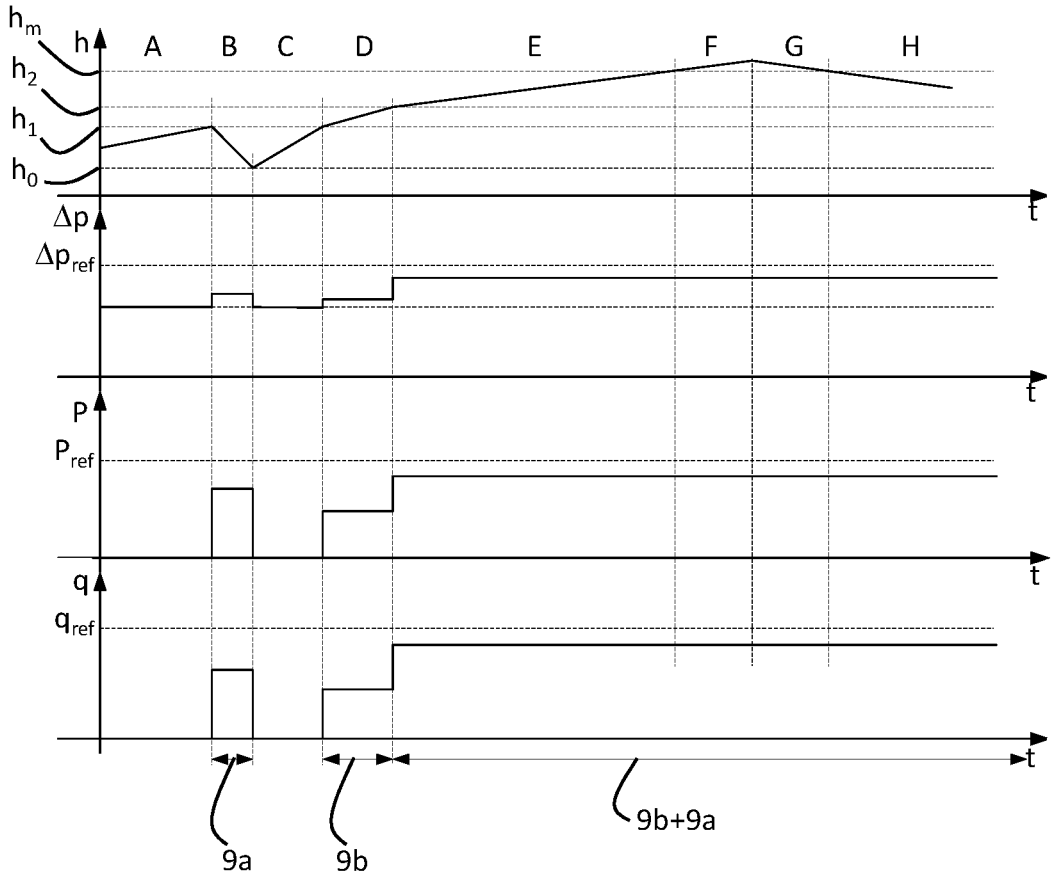
FIG. 6 is a schematic diagram of a level variable and different capacity variables over time in first situation, in which an intervention alarm is triggered by an example of the alarm management module and/or the method according to the present disclosure.

A similar inflow situation as in FIG. 5 is presented in FIG. 6. However, it can be seen from the time period D, during which only the second pump 9*b* is running, that something is wrong with the second pump 9*b*. Assuming that both pumps 9*a*, 9*b* are identical and should thus perform similarly, the lower pressure value p, the lower power value P and/or the lower flow value q compared to time period B, during which only the first pump 9*a* was running, is striking. As result, when both pumps are running during time periods E, F, G and H in order to bring the wastewater level h down, the capacity variables $$p\% = \sqrt{\frac{\Delta p}{\Delta p_{ref}}} = \sqrt{\frac{rq^2}{r_0 q_{ref}^2}},\ P\% = \frac{P - P_0}{P_{ref} - P_0}$$

and/or C %=q/$q_{ref}$ are below the capacity threshold, e.g. 95%. An intervention alarm is thus triggered during time period F. The alarm switches off in time period G as the wastewater level h is not increasing anymore.

As described before, the intervention alarm was foreseen in time period D, when a low capacity of the second pump was indicated. Therefore, pump specific capacity variables $$p_i\% = \sqrt{\frac{\Delta p_i}{0.5 \cdot \Delta p_{ref}}} = \sqrt{\frac{rq_i^2}{0.25 \cdot r_0 q_{ref}^2}},\ P_i\% = \frac{P_i - 0.5 \cdot P_0}{0.5 \cdot P_{ref} - 0.5 \cdot P_0}$$

and/or $C_i$%=$q_i$/(0.5·$q_{ref}$) are processed for each pump i during time periods B and D in order to trigger a capacity warning including a problem localisation information during time period D. In this case, the problem localisation information indicates a problem with the second pump 9*b*. An operator is thus able to quickly intervene at the second pump 9*b* before or when the intervention alarm is triggered.

Figure 7:
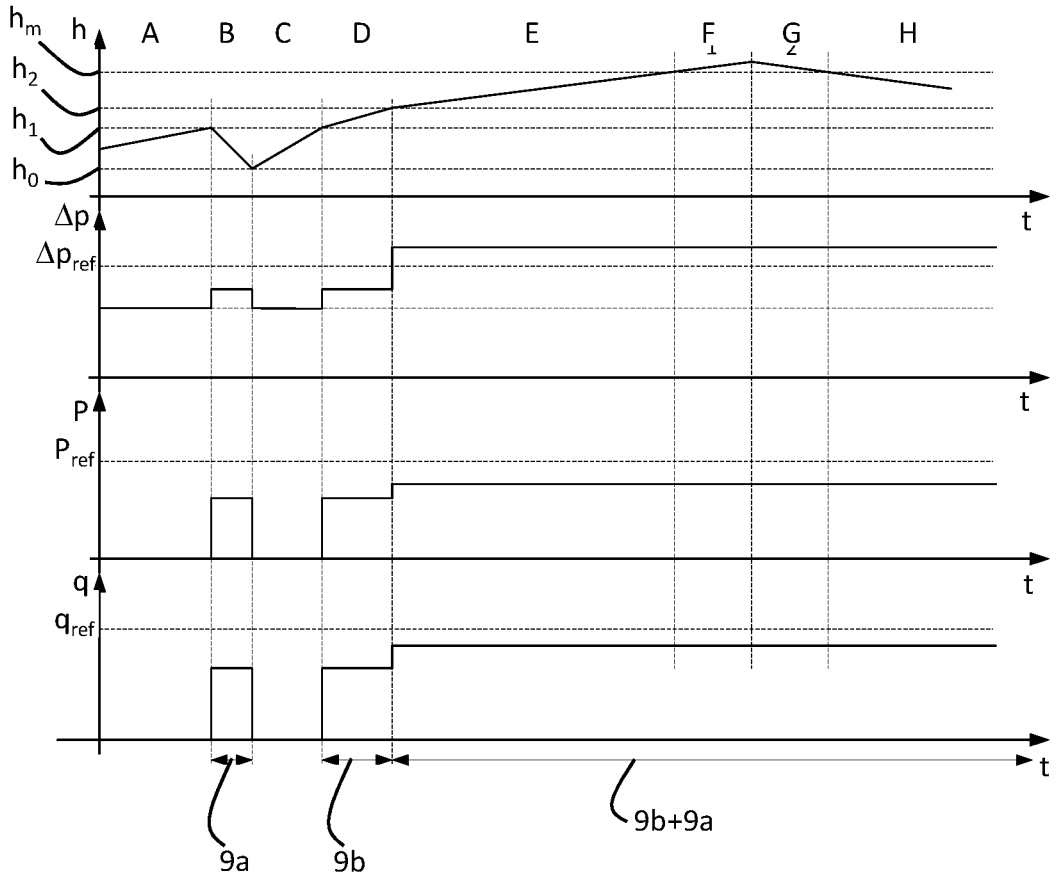
FIG. 7 is a schematic diagram of a level variable and different capacity variables over time in second situation, in which an intervention alarm is triggered by an example of the alarm management module and/or method according to the present disclosure.

In FIG. 7, the pump specific capacity variables $$p_i\% = \sqrt{\frac{\Delta p_i}{0.5 \cdot \Delta p_{ref}}} = \sqrt{\frac{rq_i^2}{0.25 \cdot r_0 q_{ref}^2}},\ P_i\% = \frac{P_i - 0.5 \cdot P_0}{0.5 \cdot P_{ref} - 0.5 \cdot P_0}$$

and/or $C_i$%=$q_i$/(0.5·$q_{ref}$) for both pumps are below the capacity threshold, e.g. 95%. The As result, when both pumps are running during time periods E, F, G and H in order to bring the wastewater level h down, the capacity variables $$p\% = \sqrt{\frac{\Delta p}{\Delta p_{ref}}} = \sqrt{\frac{rq^2}{r_0 q_{ref}^2}},\ P\% = \frac{P - P_0}{P_{ref} - P_0}$$

and/or C %=q/$q_{ref}$ are below the capacity threshold, e.g. 95%. An intervention alarm is thus triggered during time period F. The alarm switches off in time period G as the wastewater level h is not increasing anymore. As in FIG. 6, the intervention alarm in FIG. 7 was foreseen in time periods B and D, when a low capacity for both pumps was indicated. In this case, the problem localisation information indicates a pipe clogging downstream of both pumps. An operator is thus able to quickly clean the pipe downstream of both pumps before or when the intervention alarm is triggered.

Figure 8:
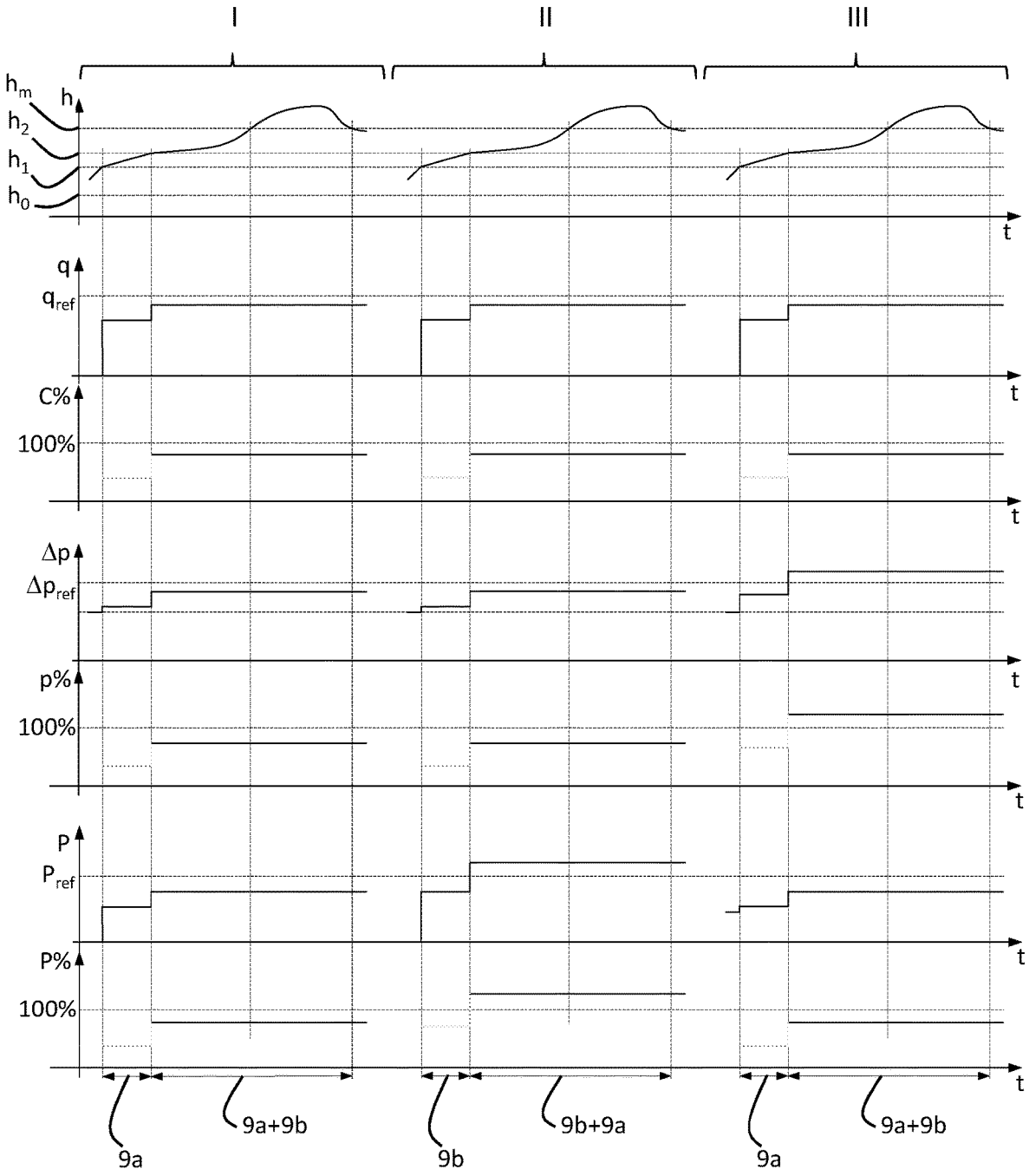
FIG. 8 is a schematic diagram of a level variable and different capacity variables over time for three different situations, in which an intervention alarm is triggered by an example of the alarm management module and/or method according to the present disclosure.

FIG. 8 shows that it may be advantageous to process more than one capacity variable. This is not only because the redundancy may reduce errors, but also to gain further information about the cause of a problematic situation. FIG. 8 shows the three different scenarios I, II and III with a similar development of the wastewater level h over time, but different developments of the capacity variables. The first scenario I is caused by a clogging in one of pumps. The second scenario II is caused by a leakage flow back into the wastewater pit 1. The third scenario III is caused by a clogging of the pipe downstream of both pumps.

The capacity variable C %=q/$q_{ref}$ is in all three scenarios I, II and III below a capacity threshold of 95%. So, in all three scenarios I, II and III, the alarm management module 13 would trigger, based on the capacity variable C %=q/$q_{ref}$, an alarm during the time period the wastewater level h is above the alarm level threshold $h_m$ and still rising.

However, if the alarm management module 13 processed the capacity variable $$p\% = \sqrt{\frac{\Delta p}{\Delta p_{ref}}} = \sqrt{\frac{rq^2}{r_0 q_{ref}^2}}$$

alone, it would show p %>105% in the third scenario III of a pipe clogging downstream of both pumps. So, when a pair of capacity variables [C %, p %] is processed, the alarm can be triggered and a capacity warning with a problem localisation information indicating a pipe clogging downstream of both pumps can be triggered.

Similarly, if the alarm management module 13 processed the capacity variable $$P\% = \frac{P - P_0}{P_{ref} - P_0}$$

alone, it would show P %>105% in the second scenario II of a leakage flow back into the pit 1. So, when a pair of capacity variables [C %, P %] is processed, the intervention alarm and a capacity warning with a problem localisation information indicating a leakage flow back into the pit 1 can be triggered. Analogously, the first scenario I of a problem with one of the pumps may be identified by processing a pair of capacity variables [p %, P %]. Preferably, pairs of a pump specific capacity variables [$C_i$%, $p_i$%], [$C_i$%, $P_i$%] and/or

[$p_i$%, $P_i$%] may be processed to identify which of the pumps may be the cause of a problem.

Figure 9:
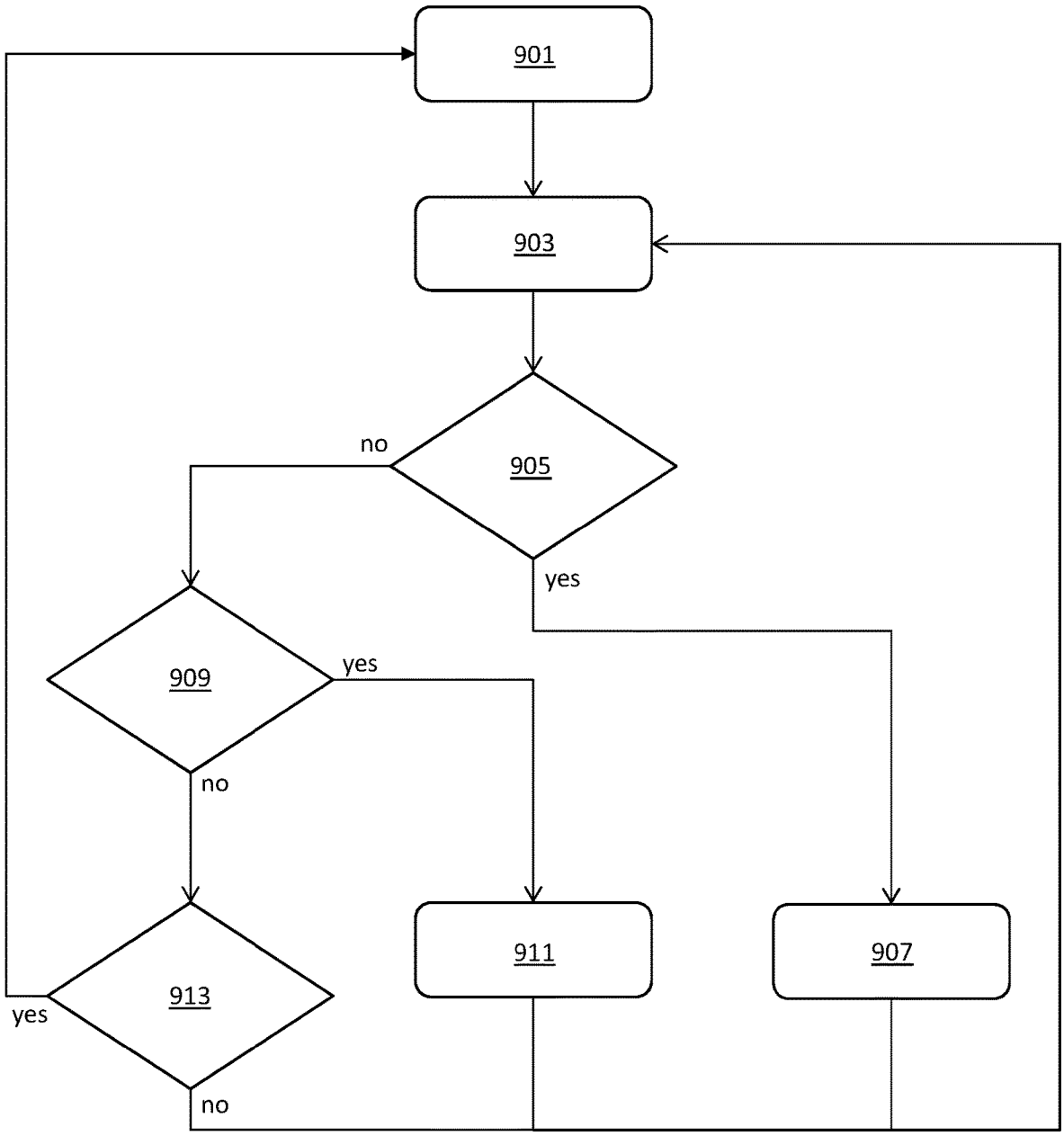
FIG. 9 is a schematic diagram of steps of an example of the method according to the present disclosure.

FIG. 9 illustrates an example of method steps for the alarm handling in the wastewater pumping station. In a first step 901, reference capacity values $C_{ref}$, $P_{ref}$ and/or $P_{ref}$ may be determined statistically during faultless operation of the wastewater pumping station. In a second step 903, at least one level variable h indicative of a filling level of the wastewater pit and a least one capacity variable $$p\% = \sqrt{\frac{\Delta p}{\Delta p_{ref}}} = \sqrt{\frac{rq^2}{r_0 q_{ref}^2}},\ P\% = \frac{P - P_0}{P_{ref} - P_0}$$

and/or C %=q/$q_{ref}$ may be processed. The step 903 of processing the level and capacity variable may be performed before or during the step 901 of determining reference capacity values. In this case, predetermined reference capacity values may be used to start processing the capacity variables. In the following step 905, it is checked whether all of the following conditions are met:

a) the at least one level variable h is at or above a predetermined alarm level threshold $h_m$, b) the at least one level variable h is increasing, and c) the at least one capacity variable variables $$p\% = \sqrt{\frac{\Delta p}{\Delta p_{ref}}} = \sqrt{\frac{rq^2}{r_0 q_{ref}^2}},\ P\% = \frac{P - P_0}{P_{ref} - P_0}$$

and/or C %=q/$q_{ref}$ is below a capacity threshold, e.g. 95%.

If all conditions in step 905 are fulfilled, an intervention alarm is triggered in step 907. If not all conditions in step 905 are fulfilled, a further check 909 may follow, in which it is checked whether all of the following conditions are met:

a) the at least one level variable h is at or above a predetermined alarm level threshold $h_m$, b) the at least one level variable h is increasing, and c) the at least one capacity variable variables $$p\% = \sqrt{\frac{\Delta p}{\Delta p_{ref}}} = \sqrt{\frac{rq^2}{r_0 q_{ref}^2}},\ P\% = \frac{P - P_0}{P_{ref} - P_0}$$

and/or C %=q/$q_{ref}$ is at or above the capacity threshold, e.g. 95%.

If all conditions in step 909 are fulfilled, an information warning is triggered in step 911. This means that an inevitable overflow is likely to happen and an operator's intervention would be futile. If not all conditions in step 909 are fulfilled, a further check 913 may follow, in which it is checked whether all of the following conditions are met:

a) the at least one level variable is below the predetermined alarm level threshold, b) the at least one level variable is not increasing, and c) the at least one capacity variable is at or above the capacity threshold.

If all conditions in step 913 are fulfilled, the wastewater pumping station is properly working without any fault indication so that the first step 901 of determining reference capacity values may be performed again.

Where, in the foregoing description, integers or elements are mentioned which have known, obvious or foreseeable equivalents, then such equivalents are herein incorporated as if individually set forth. Reference should be made to the claims for determining the true scope of the present disclosure, which should be construed so as to encompass any such equivalents. It will also be appreciated by the reader that integers or features of the disclosure that are described as optional, preferable, advantageous, convenient or the like are optional and do not limit the scope of the independent claims.

The above embodiments are to be understood as illustrative examples of the disclosure. It is to be understood that any feature described in relation to any one embodiment may be used alone, or in combination with other features described, and may also be used in combination with one or more features of any other of the embodiments, or any combination of any other of the embodiments. While at least one exemplary embodiment has been shown and described, it should be understood that other modifications, substitutions and alternatives are apparent to one of ordinary skill in the art and may be changed without departing from the scope of the subject matter described herein, and this application is intended to cover any adaptations or variations of the specific embodiments discussed herein.

In addition, "comprising" does not exclude other elements or steps, and "a" or "one" does not exclude a plural number. Furthermore, characteristics or steps which have been described with reference to one of the above exemplary embodiments may also be used in combination with other characteristics or steps of other exemplary embodiments described above. Method steps may be applied in any order or in parallel or may constitute a part or a more detailed version of another method step. It should be understood that there should be embodied within the scope of the patent warranted hereon all such modifications as reasonably and properly come within the scope of the contribution to the art. Such modifications, substitutions and alternatives can be made without departing from the spirit and scope of the disclosure, which should be determined from the appended claims and their legal equivalents.

LIST OF REFERENCE NUMERALS

1 wastewater pit
3 inflow port
5 level sensor
7 outflow port
9*a,b* pump(s)
11 force main
13 alarm management module
15 signal connection between level sensor and alarm management module
17 signal connection between pressure sensor and alarm management module
19 pressure sensor
21 signal connection between pumps(s) and alarm management module
23 signal connection between flow sensor and alarm management module
25 flow sensor
27 output device
901 determining reference capacities
903 processing level and capacity variables
905 checking conditions for intervention alarm
907 triggering intervention alarm
909 checking conditions for information warning
911 triggering information warning
913 checking conditions for determining reference capacities p % capacity variable based on pressure
P % capacity variable based on power consumption of the pump(s)
C % capacity variable based on flow
$p_{ref}$ reference capacity based on pressure
$P_{ref}$ reference capacity based on power consumption of the pump(s)
$C_{ref}$ reference capacity based on flow
$p_i$% pump specific capacity variable based on pressure
$P_i$% pump specific capacity variable based on power consumption of the pump(s)
$C_i$% pump specific capacity variable based on flow
h wastewater level variable
$h_0$ stop level threshold
$h_1$ first start level threshold
$h_2$ second start level threshold
$h_m$ alarm level threshold
H height of the wastewater pit

The invention claimed is:

1. A computer comprising an alarm management module for a wastewater pumping station with at least one pump arranged for pumping wastewater out of a wastewater pit, wherein the alarm management module is configured to process at least one level variable indicative of a filling level of the wastewater pit and at least one capacity variable indicative of a pumping capacity of the wastewater pumping station, and wherein the alarm management module is configured to trigger an intervention alarm only if all of the following conditions are met:

the at least one level variable is at or above a predetermined alarm level threshold, the at least one level variable is increasing, and the at least one capacity variable is below a capacity threshold.

2. The computer comprising an alarm management module of claim 1, wherein the alarm management module is further configured to trigger an information warning if all of the following conditions are met:

the at least one level variable is at or above the predetermined alarm level threshold, the at least one level variable is increasing, and the at least one capacity variable is at or above the capacity threshold.

3. The computer comprising an alarm management module of claim 1, wherein the capacity variable is determined relative to a predetermined reference capacity or relative to a statistically determined reference capacity.

4. The computer comprising an alarm management module of claim 1, wherein the alarm management module is further configured to statistically determine, as a basis for the capacity variable, a reference capacity during a time period when all of the following conditions are met:

the at least one level variable is below the predetermined alarm level threshold, the at least one level variable is not increasing, and the at least one capacity variable is at or above the capacity threshold.

5. The computer comprising an alarm management module of claim 1, wherein the at least one capacity variable is based on a flow variable indicative of a flow at or downstream of an outlet of the at least one pump when pumping wastewater out of the wastewater pit, a pressure variable indicative of a pressure at or downstream of an outlet of the at least one pump when pumping wastewater out of the wastewater pit, and/or a power variable indicative of a hydraulic power provided by the at least one pump when pumping wastewater out of the wastewater pit.

6. The computer comprising an alarm management module of claim 1, wherein the at least one capacity variable is based on at least one pressure signal or flow signal provided by at least one pressure sensor or flow sensor, respectively, at or downstream of an outlet of the at least one pump.

7. The computer comprising an alarm management module of claim 1, wherein the at least one capacity variable is based on an electrical variable, such as power, voltage and/or current, consumed by the at least one pump.

8. The computer comprising an alarm management module of claim 1, wherein the at least one capacity variable is based on a ratio between an actual pressure at or downstream of an outlet of the at least one pump when pumping wastewater out of the wastewater pit and a reference pressure determined during a time period when all of the following conditions are met:

the at least one level variable is below the predetermined alarm level threshold, the at least one level variable is not increasing, and the at least one capacity variable is at or above the capacity threshold.

9. The computer comprising an alarm management module of claim 1, wherein the alarm management module is further configured to process a plurality of pump specific capacity variables ($p_i$%, $P_i$%, $C_i$%) each of which is indicative of a pumping capacity of one of a plurality of pumps arranged for pumping wastewater out of the wastewater pit.

10. The computer comprising an alarm management module of claim 9, wherein the alarm management module is further configured to trigger a capacity warning including a problem localisation information, wherein the problem localisation information is based on whether:

only one of the pump specific capacity variables is below the capacity threshold indicating a problem with the associated pump, only one of the pump specific capacity variables is not below the capacity threshold indicating a backflow through the associated pump when it is turned off, or all of the pump specific capacity variables are below the capacity threshold or above an upper capacity threshold indicating a pipe clogging downstream of all the pumps.

11. The computer comprising an alarm management module of claim 1, wherein the alarm management module is further configured to process a plurality of pairs of a first pump specific capacity variable and a second pump specific capacity variable, each pair being indicative of a pumping capacity of one of a plurality of pumps arranged for pumping wastewater out of the wastewater pit, and wherein the alarm management module is configured to trigger an capacity warning including a problem localisation information, wherein the problem localisation information is based on whether:

both the first pump specific capacity variable and second pump specific capacity variable of only one of the pumps are below the capacity threshold indicating a problem with the associated pump, the first pump specific capacity variable of only one of the pumps is not below the capacity threshold indicating backflow through the associated pump when it is turned off, the first pump specific capacity variables of all of the pumps are above an upper capacity threshold and the second pump specific capacity variables of all of the pumps are not below the capacity threshold indicating a pipe clogging downstream of all the pumps, or the first pump specific capacity variable of all of the pumps except for one pump are above an upper capacity threshold and the second pump specific capacity variable of all of the pumps except for said one pump are not below the capacity threshold indicating a pipe clogging downstream of all the pumps and a problem with said one pump.

12. A method for operating a wastewater pumping station with at least one pump arranged for pumping wastewater out of a wastewater pit, the method comprising:

processing at least one level variable indicative of a filling level of the wastewater pit and a least one capacity variable indicative of a pumping capacity of the wastewater pumping station, and triggering an intervention alarm only if all of the following conditions are met:

the at least one level variable is at or above a predetermined alarm level threshold, the at least one level variable is increasing, and the at least one capacity variable is below a capacity threshold.

13. The method of claim 12, further comprising:

triggering an information warning if all of the following conditions are met:

the at least one level variable is at or above the predetermined alarm level threshold, the at least one level variable is increasing, and the at least one capacity variable is at or above the capacity threshold.

14. The method of claim 12, wherein the capacity variable is determined relative to a predetermined reference capacity and/or relative to a statistically determined reference capacity.

15. The method of claim 12, further comprising:

statistically determining, as a basis for the capacity variable, a reference capacity during a time period when all of the following conditions are met:

the at least one level variable is below the predetermined alarm level threshold, the at least one level variable is not increasing, and the at least one capacity variable is at or above the capacity threshold.

16. The method of claim 12, wherein the at least one capacity variable is based on a flow variable indicative of a flow at or downstream of an outlet of the at least one pump when pumping wastewater out of the wastewater pit, a pressure variable indicative of a pressure at or downstream of an outlet of the at least one pump when pumping wastewater out of the wastewater pit, and/or a power variable indicative of a hydraulic power provided by the at least one pump when pumping wastewater out of the wastewater pit.

17. The method of claim 12, wherein the at least one capacity variable is based on at least one pressure signal or flow signal provided by at least one pressure sensor or flow sensor, respectively, at or downstream of an outlet of the at least one pump.

18. The method of claim 12, wherein the at least one capacity variable is based on an electrical variable, such as power, voltage and/or current, consumed by the at least one pump.

19. The method of claim 12, wherein the at least one capacity variable is based on a ratio between an actual pressure at or downstream of an outlet of the at least one pump when pumping wastewater out of the wastewater pit and a reference pressure determined during a time period when all of the following conditions are met:

the at least one level variable is below the predetermined alarm level threshold, the at least one level variable is not increasing, and the at least one capacity variable is at or above the capacity threshold.

20. The method of claim 12, further comprising: processing a plurality of pump specific capacity variables each of which is indicative of a pumping capacity of one of a plurality of pumps arranged for pumping wastewater out of the wastewater pit.

21. The method of claim 20, further comprising:

triggering a capacity warning including a problem localisation information, wherein the problem localisation information is based on whether:

only one of the pump specific capacity variables is below the capacity threshold indicating a problem with the associated pump, only one of the pump specific capacity variables is not below the capacity threshold indicating a backflow through the associated pump when it is turned off, or all of the pump specific capacity variables are above an upper capacity threshold indicating a pipe clogging downstream of all the pumps.

22. The method of claim 12, further comprising:

processing a plurality of pairs of a first pump specific capacity variable and a second pump specific capacity variable, each pair being indicative of a pumping capacity of one of a plurality of pumps arranged for pumping wastewater out of the wastewater pit, and triggering a capacity warning including a problem localisation information, wherein the problem localisation information is based on whether:

both the first pump specific capacity variable and second pump specific capacity variable of only one of the pumps are below the capacity threshold indicating a problem with the associated pump, the first pump specific capacity variable of only one of the pumps is not below the capacity threshold indicating a problem downstream of the associated pump, the first pump specific capacity variables of all of the pumps are above an upper capacity threshold and the second pump specific capacity variables of all of the pumps are not below the capacity threshold indicating a pipe clogging downstream of all the pumps, or the first pump specific capacity variable of all of the pumps except for one pump are above an upper capacity threshold and the second pump specific capacity variable of all of the pumps except for said one pump are not below the capacity threshold indicating a pipe clogging downstream of all the pumps and a problem with said one pump.

* * * * *